US011745903B2

(12) United States Patent
Breitmar

(10) Patent No.: US 11,745,903 B2
(45) Date of Patent: Sep. 5, 2023

(54) DEVICE AND METHOD FOR THE SHAPING OF GABLE SURFACES OF PACKAGES WITH A SLANTED GABLE

(71) Applicant: SIG Technology AG, Neuhausen am Rheinfall (CH)

(72) Inventor: Felix Breitmar, Moenchengladbach (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 362 days.

(21) Appl. No.: 16/090,365

(22) PCT Filed: Mar. 16, 2017

(86) PCT No.: PCT/EP2017/056199
§ 371 (c)(1),
(2) Date: Oct. 1, 2018

(87) PCT Pub. No.: WO2017/174318
PCT Pub. Date: Oct. 12, 2017

(65) Prior Publication Data

US 2019/0112081 A1 Apr. 18, 2019

(30) Foreign Application Priority Data

Apr. 4, 2016 (DE) ..... 10 2016 106 139.5
May 31, 2016 (DE) ..... 10 2016 109 980.5

(51) Int. Cl.
*B65B 3/02* (2006.01)
*B65B 43/32* (2006.01)
(Continued)

(52) U.S. Cl.
CPC ..... *B65B 3/025* (2013.01); *B31B 50/006* (2017.08); *B31B 50/28* (2017.08); *B31B 50/322* (2017.08);
(Continued)

(58) Field of Classification Search
CPC ..... B65B 61/24; B65B 3/025; B65B 43/145; B65B 43/26; B65B 43/325; B65B 43/50;
(Continued)

(56) References Cited

U.S. PATENT DOCUMENTS 2,514,867 A 7/1950 Howard et al.
4,614,079 A 9/1986 Ida et al.
(Continued)

FOREIGN PATENT DOCUMENTS

CN 102666292 A 9/2012
DE 3835390 A1 4/1990
(Continued)

*Primary Examiner* — Valentin Neacsu
*Assistant Examiner* — Mary C Hibbert-Copeland
(74) *Attorney, Agent, or Firm* — THE WEBB LAW FIRM

(57) ABSTRACT

A device for shaping the gable surfaces of packages with a slanted gable is shown and described, including: a conveyor system with cells fixed to it to receive the packages, at least one gable folder to fold a fin seam in the gable region of the packages and at least two ear folders to fold ears in the gable region of the packages. In order to enable rapid and reliable shaping of the gable even in packages with slanted gables, it is proposed that both the gable folder and the ear folders be mounted movably relative to the conveyor system and the packages to be transported therewith. A method for shaping the gable surfaces of packages with a slanted gable is also shown and described.

14 Claims, 8 Drawing Sheets

(51) Int. Cl.

| | |
|---|---|
| ***B65B 43/50*** | (2006.01) |
| ***B65B 7/16*** | (2006.01) |
| ***B31B 50/28*** | (2017.01) |
| ***B31B 50/78*** | (2017.01) |
| ***B31B 50/00*** | (2017.01) |
| ***B31B 50/32*** | (2017.01) |
| ***B65B 61/24*** | (2006.01) |
| ***B65B 43/54*** | (2006.01) |
| ***B65B 41/06*** | (2006.01) |
| ***B65B 43/26*** | (2006.01) |
| ***B65B 43/14*** | (2006.01) |
| ***B65B 55/10*** | (2006.01) |
| *B31B 105/00* | (2017.01) |
| *B31B 100/00* | (2017.01) |

(52) U.S. Cl.
CPC ..... *B31B 50/782* (2017.08); *B31B 50/788* (2017.08); *B65B 7/16* (2013.01); *B65B 41/06* (2013.01); *B65B 43/145* (2013.01); *B65B 43/26* (2013.01); *B65B 43/325* (2013.01); *B65B 43/50* (2013.01); *B65B 43/54* (2013.01); *B65B 55/10* (2013.01); *B65B 61/24* (2013.01); *B31B 2100/0022* (2017.08); *B31B 2105/0022* (2017.08)

(58) Field of Classification Search
CPC ..... B65B 43/54; B31B 50/788; B31B 50/006; B31B 50/782; B31B 50/28; B31B 50/322
USPC ..... 53/491
See application file for complete search history.

(56) References Cited

U.S. PATENT DOCUMENTS

| | | | | |
|---|---|---|---|---|
| 5,000,375 | A | 3/1991 | Farber et al. | |
| 5,809,743 | A * | 9/1998 | Ylonen | B65B 51/144 53/370.6 |
| 5,836,139 | A | 11/1998 | Yoshida et al. | |
| 5,875,959 | A | 3/1999 | Weiteder et al. | |
| 6,560,950 | B1 | 5/2003 | Johansson | |
| 7,955,242 | B2 | 6/2011 | Fontanazzi et al. | |
| 9,475,595 | B2 | 10/2016 | Paradisi et al. | |
| 2009/0193763 | A1 | 8/2009 | Fontanazzi et al. | |
| 2011/0113733 | A1 | 5/2011 | Franic | |
| 2012/0279182 | A1 | 11/2012 | Barbieri et al. | |
| 2013/0237396 | A1 | 9/2013 | Paradisi et al. | |
| 2014/0194267 | A1 | 7/2014 | Pradelli | |
| 2014/0371046 | A1* | 12/2014 | Catellani | B65B 61/24 493/162 |
| 2017/0015078 | A1* | 1/2017 | Von Birgelen | B65B 43/24 |

FOREIGN PATENT DOCUMENTS

| | | | |
|---|---|---|---|
| EP | 0061663 | A2 | 10/1982 |
| EP | 0819602 | A2 | 1/1998 |
| EP | 1826126 | A1 | 8/2007 |
| EP | 1826127 | A1 | 8/2007 |
| EP | 2468641 | A1 | 6/2012 |
| JP | 04201805 | A | 7/1992 |
| JP | 07110651 | B2 | 11/1995 |
| JP | 09086510 | A | 3/1997 |
| JP | 1177856 | A | 3/1999 |
| WO | 2009030910 | A2 | 3/2009 |
| WO | 2009141389 | A2 | 11/2009 |
| WO | 2015040026 | A1 | 3/2015 |
| WO | 2015124396 | A9 | 8/2015 |

* cited by examiner

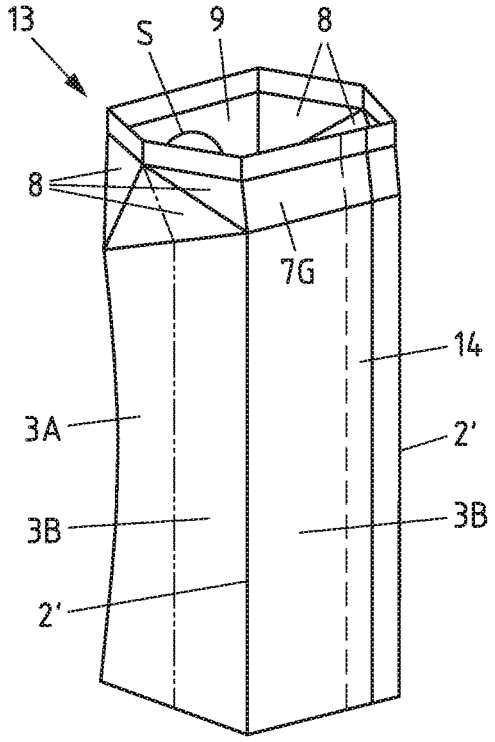
Fig.1F
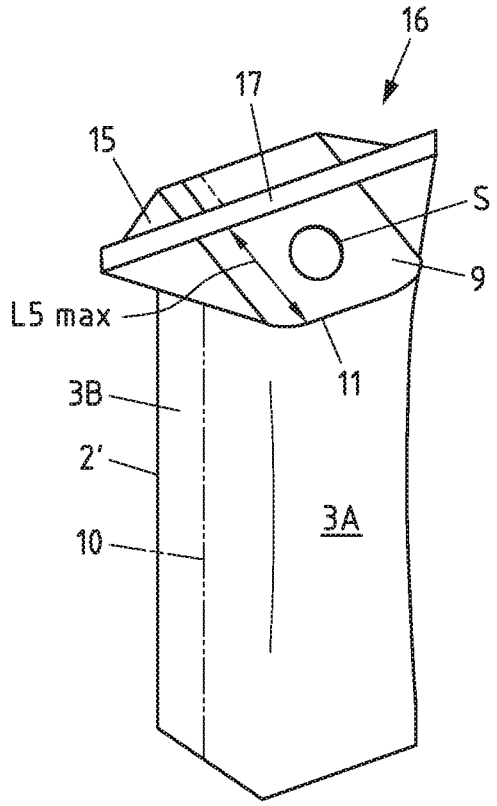
Fig.1G
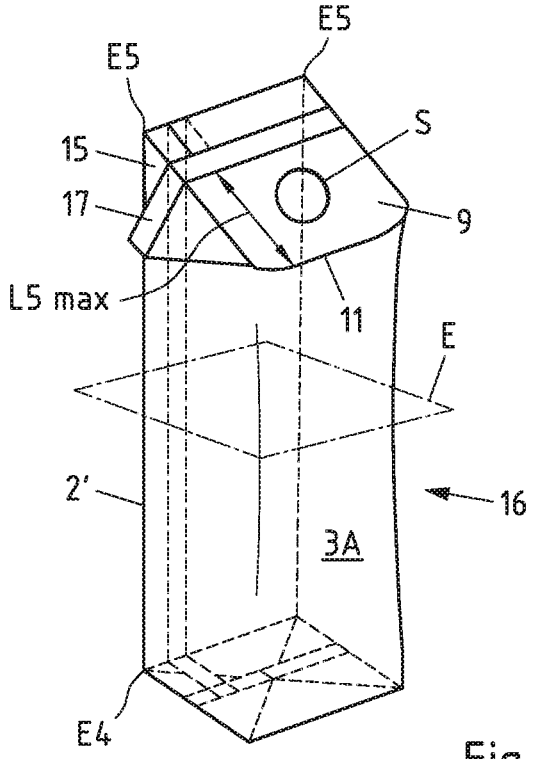
Fig.1H
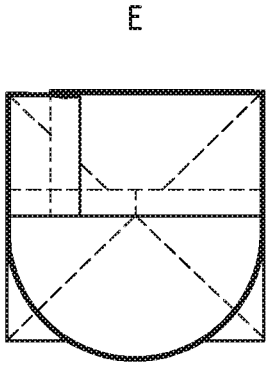

DEVICE AND METHOD FOR THE SHAPING OF GABLE SURFACES OF PACKAGES WITH A SLANTED GABLE

CROSS-REFERENCE TO RELATED APPLICATIONS

This application is the United States national phase of International Application No. PCT/EP2017/056199 filed Mar. 16, 2017, and claims priority to German Patent Application Nos. 10 2016 106 139.5 and 10 2016 109 980.5 filed Apr. 4, 2016, and May 31, 2016, respectively, the disclosures of which are hereby incorporated in their entirety by reference.

BACKGROUND OF THE INVENTION

The invention relates to a device for the shaping of gable surfaces of packages with a slanted gable, comprising: a conveyor system with cells fixed to it for receiving the packages, at least one gable folder for folding a fin seam in the gable region of the packages and at least two ear folders for folding ears in the gable region of the packages.

The invention also relates to a method for the shaping of gable surfaces of packages with a slanted gable comprising the following steps: a) Provision of packages with slanted gables, b) Folding of the fin seam in the gable region of the packages by means of a gable folder and c) Folding of the ears in the gable region of the packages by means of two ear folders.

Field of the Invention

Packages can be manufactured in various ways and from various different materials. A common option for manufacturing is to manufacture a blank with a standard folding line (also known as a "crease line") from which initially a package sleeve and ultimately the package itself can be created by means of folding and further steps. Among other things, this variant has the advantage that the blanks are very flat and can therefore be stacked in a manner which saves space. In this way, the blanks or package sleeves can be manufactured in a different location to the one in which the folding and filling of the package sleeves takes place. Composite materials are often used as the material, for example a composite made of several thin layers of paper, cardboard, plastic or metal. Packages of this type are very widespread in the food industry in particular.

Description of Related Art

Packages made from blanks are known, for example, from WO 2009/141389 A2 and DE 38 35 390 A1. These examples of packages predominantly have gable surfaces which rise at an identical angle towards the middle on both sides and are therefore symmetrically shaped. The fin seam is therefore the highest point in the package, at least before it is folded.

When manufacturing packages of this type, there is a challenge in ensuring that protruding areas of the package are created such as seams or "ears". In cuboid packages this is quite easy; a machine to do this is known for example from EP 0 061 663 A2.

Packages with asymmetrical—in other words entirely slanted—gables can also be manufactured from blanks. Packages of this type are known for example from WO 2009/030910 A2 and EP 2 468 641 B1. In these examples of packages, the creation of protruding areas is particularly difficult as it is often not the fin seam but rather the rear edge of the gable which forms the highest point in the packages in slanted gable packages of this type. This leads to the fin seam being more difficult for tools to access. In particular, the fin seam cannot be applied by a fixed tool which the package passes in this type of packages.

In EP 2 468 641 B1 the shaping of the package takes place on a pivotable mandrel wheel with several stations. The folding of the ears is initially carried out by means of fixed rails over which the packages are passed and then by means of mobile folding tools. The fin seam in the gable region of the packages is moved such that the package is pushed between two fixed columns with the gable first until the fin seam hits an also fixed and slanted stop, thereby being folded (Para. [0068]). A disadvantage of this approach is the high level of constructional complexity. The packages which have already been filled and sealed have to be conveyed to a mandrel wheel provided specifically for this purpose solely so that it can be shaped. A further disadvantage is that most of the folding processes are carried out on fixed folding tools which the package passes. This leads to undesirable acceleration of the package and its sensitive content.

Against this background, the object of the invention is to enable the rapid and reliable shaping of the gable even in packages with a slanted gable.

This object is achieved in a device in accordance with the preamble of claim 1 in that both the gable folder and the ear folder are mounted movably (in a mobile manner) relative to the conveyor system and the packages to be transported therewith.

SUMMARY OF THE INVENTION

The device is a device for the shaping of gable surfaces of packages with a slanted gable, in particular with a continuously slanted gable. The fin seam and the ears in the gable region are in particular (re)shaped. The package is preferably a package for food made of a composite material. The composite material can have several thin layers made of paper, cardboard, plastic or metal. The device initially comprises a conveyor system with cells fixed to it for receiving the packages. Through a conveyor system (for example a transport belt, a conveyor belt or a transport chain), high tensile forces can be transferred enabling a plurality of package sleeves to be transported at constant distances from one another. The cells are used to receive the package sleeves. The package sleeves can be held in the cells either by means of a positive-locking connection or by means of a frictional connection. The conveyor system is preferably arranged in a horizontal plane. The device also comprises at least one gable folder for folding a fin seam in the gable region of the packages. The gable folder is preferably arranged centrally above the conveyor system and the packages transported on said conveyor system. In addition to this, the device comprises at least two ear folders for folding ears in the gable region of the packages. The two ear folders are preferably arranged above the conveyor system and the packages transported on said conveyor system on both sides adjacent to the gable folder.

The invention provides for both the gable folder and the ear folder to be mounted movably relative to the conveyor system and the packages transported by means of said conveyor system. In other words, the gable folder and the ear folder should be mounted in a rotatable, pivotable, displaceable or otherwise mobile manner. Through these design measures, it is possible for the relative movement between the folding tools (in other words the gable folder and the ear folders) and the packages necessary for the shaping to be achieved by means of a movement of the folding tools and not by means of a movement of the packages. As a result, the package does not need to be moved during the shaping, so the conveyor system can be still. The conveyor system can therefore be operated in an intermittent, cyclical manner. Shaping a package that is not moving has the advantage that the packages can be filled particularly easily as the filling device does not have to be moved as well. A further advantage is that as a result of the folding tools being mounted in a mobile manner, packages can also be shaped in which the rear edge of the gable rather than the fin seam forms the highest point of the packages. In addition to moving the fin seam and applying the ears, the folding tools can also be used to shape other areas of the gable, for example the curved front edge of the gable.

In accordance with an embodiment of the device, there is a provision for the gable folder to be mounted movably in one plane, in particular in a plane formed by the direction of transport and the vertical direction of the packages. The gable folder should therefore not merely be able to be pushed in a linear direction but should also have at least two-dimensional mobility. In the plane of movement, the gable folder can make translational movements, rotational movements or combinations of the two (overlapping of translational and rotational movements). The plane of movement of the gable folder is preferably formed by the direction of transport and the vertical direction of the packages.

A further embodiment of the device provides for the ear folders to be mounted movably in one plane, in particular in a plane formed by the vertical direction and the transverse direction of the packages. The ear folders should also not merely be able to be pushed in a linear direction but should also have at least two-dimensional mobility. In the plane of movement, the ear folders can make translational movements, rotational movements or combinations of the two (overlapping of translational and rotational movements). The plane of movement of the ear folders is preferably formed by the vertical direction and the transverse direction of the packages.

In accordance with a further embodiment of the device, it is proposed that the gable folder be arranged between the two ear folders. The gable folder and the ear folders are preferably arranged above the conveyor system and the packages transported on said conveyor system. A particularly compact design is achieved by the gable folder being arranged between the two ear folders. This is particularly advantageous in the case of systems in which several parallel rows of packages are processed at the same time. In addition to this, tests have shown that the gable folder can reliably move the fin seam if it does not cover the entire width of the fin seam but rather approximately the width of the packages (not including the protruding ears).

In terms of the gable folder, in a further embodiment of the device there is a provision for the gable folder to be mounted movably such that it can move the fin seam in the direction of transport of the packages in the gable region. This should also be possible if the slanted gables of the packages rise in the direction of transport. The fin seam should therefore be moved "upwards". From a design perspective, this is achieved by the gable folder not being mobile solely in a vertical direction but also being mounted in a mobile manner in the direction of transport of the packages. The direction of movement of the gable folder should therefore (in any case also) have a movement component in the direction of transport in order to be able to move the fin seam in this direction.

A further embodiment of the device is characterised by at least two, in particular at least four gable folders for folding a fin seam in the gable region of the packages and at least four, in particular at least eight ear folders for folding ears in the gable region of the packages, whereby one gable folder and two ear folders form a unit for processing a package in each case. This embodiment means that several packages can be processed at the same time. In order to do this, several conveyor belts running in parallel with one another can, for example, be provided. Each row of packages to be processed is preferably allocated a unit made up of one gable folder and two ear folders. A unit means a group of folding tools which are arranged such that they can process the same package.

With this embodiment, it is further proposed that all of the gable folders be arranged adjacent to one another and connected to one another, and that all of the ear folders be arranged adjacent to one another and connected to one another. All of the gable folders should therefore be connected, for example by means of a common rail to which all of the gable folders are fixed. All ear folders should also be connected; this can also be by means of fixing to a common rail. Connecting the gable folders to one another has the advantage that all of the gable folders can be moved synchronously by means of a common drive. The connection between them means all of the ear folders can also be moved synchronously by a common drive.

The object described at the outset is achieved by means of a method for the shaping of the gable surfaces of packages with slanted gables. The method comprises the following steps: a) Provision of packages with slanted gables, b) Folding of the fin seam in the gable region of the packages by means of a gable folder, and c) Folding of the ears in the gable region of the packages by means of two ear folders. The method is characterised by the fact that in steps b) and c) both the gable folder and the ear folders are moved relative to the conveyor system and the packages transported by said conveyor system. The provision of the packages can in particular be by means of a conveyor system in the form of a conveyor belt or a transport belt or a transport chain with cells fixed to it to receive the packages. The conveyor belt or transport belt or transport chain is preferably arranged in a horizontal plane. As already described in connection with the device, it should be the relative movement between the folding tools (in other words the gable folder and the ear folders) and the packages necessary for the shaping should be achieved by means of a movement of the folding tools and not by means of a movement of the packages. As a result, the package does not have to be moved during shaping, enabling the conveyor system to be operated in an intermittent, cyclical manner. Shaping while the packages is not moving has the advantage that filling can also be carried out without the packages moving, and the processing of packages in which it is not the fin seam but rather the rear edge of the gable which is the highest point in the packages is also possible. The method is preferably carried out with a device in accordance with any one of claims 1 to 7.

In accordance with an embodiment of the method, there is a provision for the packages to be moved by means of a conveyor system with cells fixed to it. As already described in connection with the device, through a conveyor system (for example a transport belt, a conveyor belt or a transport chain), high tensile forces can be transferred enabling a plurality of package sleeves to be transported at constant distances from one another. The cells are used to receive the package sleeves. The package sleeves can be held in the cells either by means of a positive-locking connection or by means of a frictional connection. The conveyor system is preferably arranged in a horizontal plane.

In accordance with a further embodiment of the method, there is a provision for the packages to be moved intermittently. Intermittent, in other words cyclical, operation has the advantage that the packages are briefly still and more precise work can be carried out during this phase. A further advantage is that the tools used to process the packages do not have to be moved along with the packages.

A further embodiment of the method provides for the packages to be still during step b) and step c). Steps b) and c) are used to move the fin seam and apply the protruding ears. These steps should be carried out in as precise and rapid a manner as possible without damaging or deforming the packages. These requirements are simpler to meet when the packages are not moving than when the packages are constantly moving.

In accordance with a further embodiment of the method, there is a provision for step b) to be carried out before step c). Alternatively or additionally, there is a provision for step b) and step c) to overlap in terms of the time at which they are carried out. The fin seam is preferably moved (step b) before the ears are applied to the packages (step c). An advantage of this order is that the ears can be applied more easily if the fin seam has already been moved. This is because the fin seam stretches into the region of the ears. Equally, both of these steps can also be carried out at the same time. in particular, it is possible to start with the application of the ears before the movement of the fin seam is entirely complete. This enables the gable to be shaped as quickly as possible and therefore short cycles.

In accordance with a further embodiment of the method, there is a provision for the gable folder to move the fin seam in the direction of transport of the packages in the gable region. This should also be possible if the slanted gables of the packages rise in the direction of transport. The fin seam should therefore be moved "upwards". This enables the gable folder to not only be moved in a vertical direction but also in the direction of transport of the packages. The direction of movement of the gable folder should therefore (in any case also) have a movement component in the direction of transport in order to be able to move the fin seam in this direction.

In accordance with a further development of the method, there is finally a provision for the gable surfaces to be shaped simultaneously by at least two, in particular by at least four packages at the same time. This further development means that several packages can be processed at the same time. In order to do this, several conveyor belts running in parallel with one another can, for example, be provided. Each row of packages to be processed is preferably allocated a unit made up of one gable folder and two ear folders. A unit means a group of folding tools which are arranged such that they can process the same package.

BRIEF DESCRIPTION OF THE DRAWINGS

The invention is explained in greater detail below by means of drawings which merely depict embodiments, in which.

DESCRIPTION OF THE INVENTION

Figure 1A:
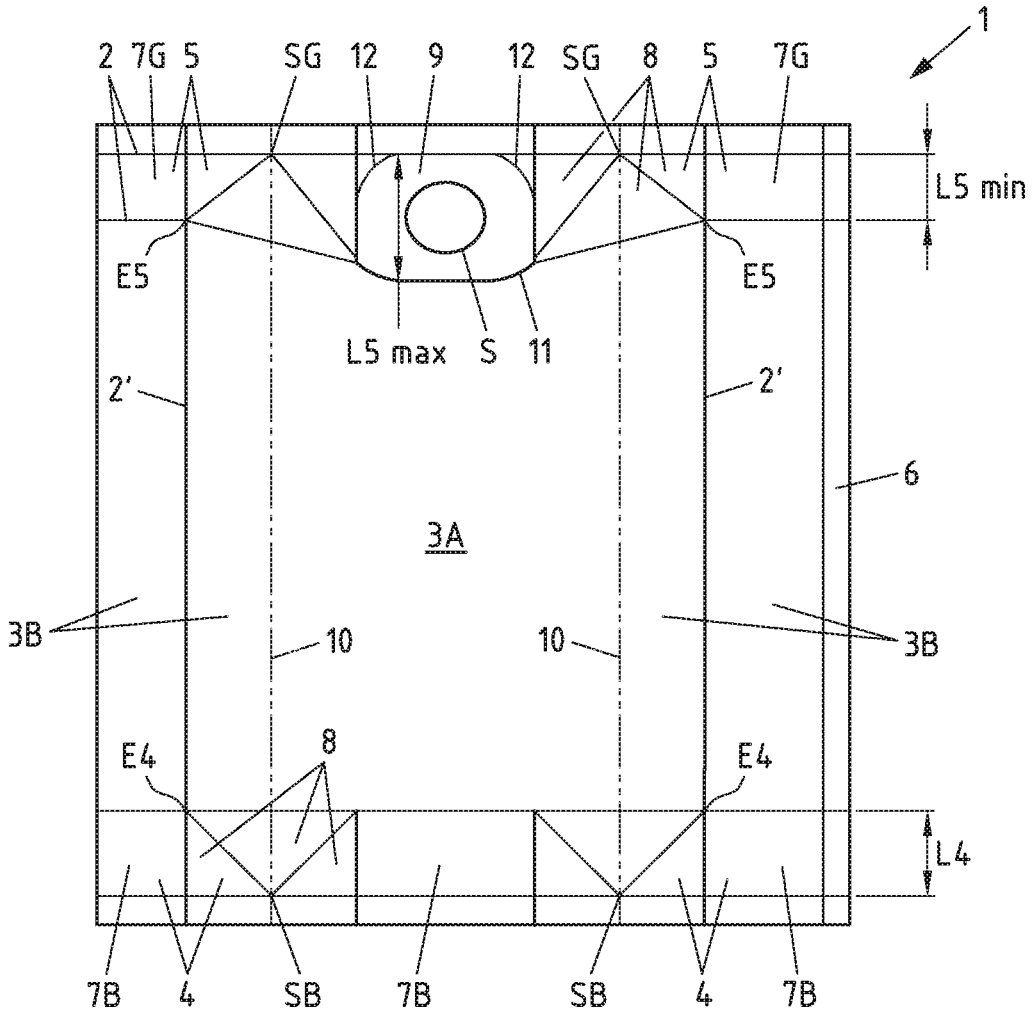
FIG. 1A: shows a blank used to fold a package sleeve.

FIG. 1A shows a blank 1 for the folding of a package sleeve. The blank 1 can comprise several layers of different materials, for example paper, cardboard, plastic or metal, in particular aluminium. The blank 1 has several folding lines 2, the purpose of which is to facilitate the folding of the blank 1 and which divide the blank 1 into several surfaces. The blank 1 can be subdivided into a sleeve surface 3, base surface 4, gable surface 5 and sealing surface 6. The base surfaces 4 and the gable surfaces 5 each comprise rectangular surfaces 7, 7B, 7G and triangular surfaces 8. The gable surfaces 5 also comprise a centrally arranged main gable surface 9. With the exception of the sealing surface 6, the sleeve surface 3 extends over the entire width of the blank 1. A package sleeve can be formed from the blank 1 by the blank 1 being folded such that the sealing surface 6 is joined to the opposite end of the sleeve surface 3, in particular this is fused.

The blank 1 shown in FIG. 1A has two apparent folding lines 10 in the region of the sleeve surface 3. Both of the apparent folding lines 10 run in parallel to one another and through a contact point SB of three adjacent triangular surfaces 8 of the base surface 4 and through a contact point SG of three adjacent triangular surfaces 8 of the gable surfaces 5. The sleeve surface 3 is divided into an inner partial region 3A and two outer partial regions 3B by the apparent folding lines 10. The inner partial region 3A is between the two apparent folding lines 10 and the outer partial regions 3B are outside of the two apparent folding lines 10.

While the base surface 4 has a length L4 which is constant over the entire width of the blank 1, the length of the gable surface 5 differs. The gable surface 5 has a decreased length $L5_{min}$ adjacent to the outer partial regions 3B of the sleeve surface 3. However, adjacent to the inner partial region 3A of the sleeve surface 3 (in other words in the region of the main gable surface 9), the gable surface 5 has an increased length $L5_{max}$. This design means that the inner partial region 3A is lower than the outer partial region 3B. This results in an inclined, slanted gable region which slopes in a forward direction for the packages to be manufactured.

The rectangular surfaces 7B in the base region of the blank are rectangular. Both of the external rectangular surfaces 7G in the gable region of the blank are also rectangular. The central main gable surface 9, however, is not precisely rectangular; rather it is formed with a front edge 11 which is curved in a convex manner at least in sections. In the upper corner regions of the main gable surface 9 it is possible to recognise two curved stamped lines 12 which give the main gable surface 9 a shape reminiscent of an ellipse. A circle-shaped tear line S is shown in the centre within the main gable surface 9. This is preferably a circular recess in the carrier material which is overstretched with the remaining plastic and where applicable aluminium layers of the composite material forming what is known as a "coated hole". The diameter of this can be adapted to the size of the cutting element of a pouring element to be applied there or can be designed to be relatively small to enable a straw to penetrate this.

The base surfaces 4 have two corner points E4 and the gable surfaces 5 have two corner points E5. The corner points E4, E5 are corner points of the package to be manufactured from the blank 1. Each corner point E4 of a base surface 4 is allocated a corresponding corner point E5 of a gable surface 5 which is in each case the corner point E5 which is arranged above this corner point E4 when the packages is standing up. A folding line 2' runs through two corresponding corner points E4, E5 in each case and is used to form a rear (vertical) edge of the package to be manufactured. However, there are only two continuous folding lines 2' in the blank 1 shown in FIG. 1A, as there are for the package sleeve manufactured from this and the packages manufactured from this. However, no folding lines are provided between the further corner points of the base surfaces 4 and the corresponding corner points of the gable surfaces 5, in other words on the front sleeve surface 3A.

Figure 1B:
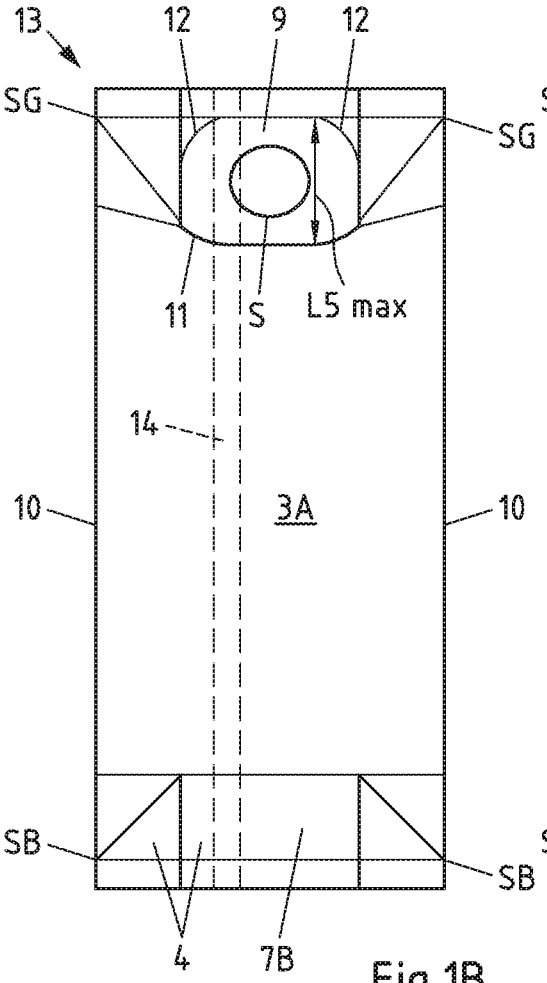
FIG. 1B: is a front view of a package sleeve which is formed from the blank shown in FIG. 1A when folded flat.

FIG. 1B is a front view of package sleeve 13 which is formed from the blank 1 shown in FIG. 1A when folded flat. The regions of the package sleeve already described in connection with FIG. 1A are labelled accordingly in FIG. 1B. The package sleeve 13 is created from the blank 1 in two steps: The blank 1 is initially folded along the two apparent folding lines 10. The two partial areas 3B (left) and 3B (right) of the sleeve surface 3 are then joined together in the region of the sealing surface 6, in particular they are fused, resulting in a longitudinal seam 14 (hidden in FIG. 1B). The package sleeve 1 therefore has a structure which is sealed in a circumferential direction with an opening in the region of the base surfaces 4 and with an opening in the region of the gable surfaces 5. The inner partial region 3A of the sleeve surface 3 is visible in the front view, both sides of which are delimited by the apparent folding lines 10. The remaining partial regions 3B of the sleeve surface 3 are on the back of the package sleeve 13 and therefore hidden in FIG. 1B.

Figure 1C:
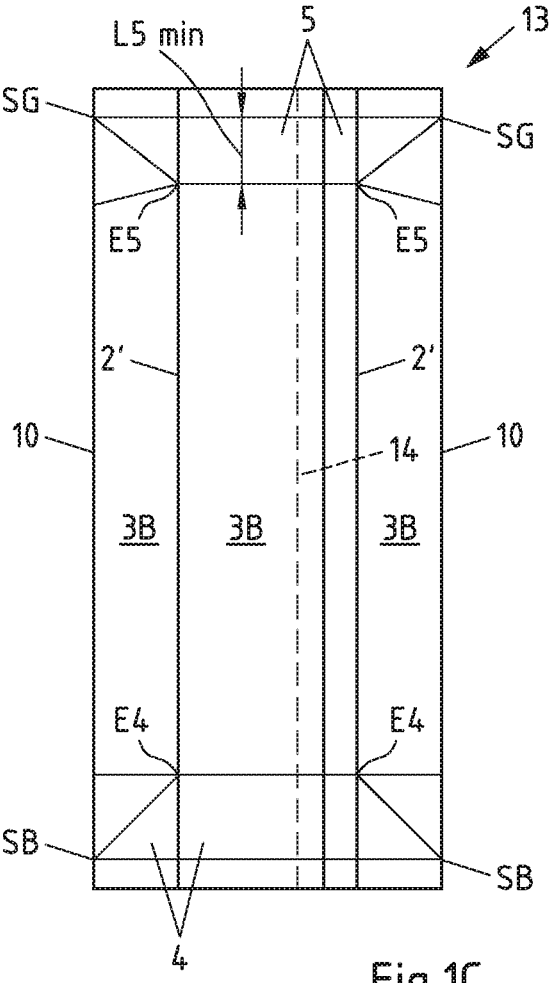
FIG. 1C: is a rear view of the package sleeve from FIG. 1B, FIG. 1D: shows the package sleeve from FIG. 1B and FIG. 1C in its unfolded state.

FIG. 1C is a rear view of the package sleeve 13 from FIG. 1B. The regions of the package sleeve already described in connection with FIG. 1A and FIG. 1B are labelled accordingly in FIG. 1C. Both of the external partial regions 3B of the sleeve surface 3 are visible in the rear view. They are joined together by means of the longitudinal seam 14 and are delimited on both sides by the apparent folding lines 10. The front partial region 3A of the sleeve surface 3 is on the front of the package sleeve 13 and therefore hidden in FIG. 1C.

Figure 1D:
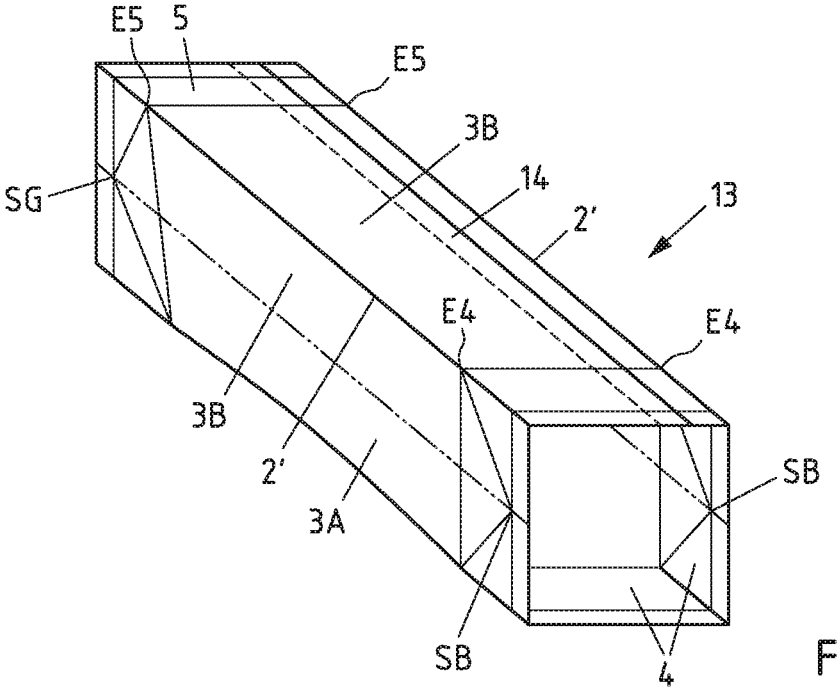
FIG. 1E: shows the package sleeve from FIG. 1B to FIG. 1D with the base sealed.
FIG. 1F: shows the package sleeve from FIG. 1B to FIG. 1E with pre-folded gable surfaces.
FIG. 1G: shows a package manufactured from the package sleeve shown in FIG. 1B to FIG. 1F with an unshaped gable.
FIG. 1H: shows the package from FIG. 1G with a shaped gable.

FIG. 1D shows the package sleeve 13 from FIG. 1B and FIG. 1C in its unfolded state. The regions of the package sleeve already described in connection with FIG. 1A to FIG. 1C are labelled accordingly in FIG. 1D. The unfolded state is achieved by folding the package sleeve 13 back along the apparent folding lines 10 which run through the sleeve surface 3. It is folded back approximately 180°. This folding back along the apparent folding lines 10 results in the two partial areas 3A, 3B of the sleeve surface 3 adjacent to the apparent folding lines 10 no longer lying flat on top of one another but rather being arranged in the same plane. The package sleeve 13 is therefore only folded along the apparent folding lines 10 when it is flat (FIG. 1B, FIG. 1C); when it is unfolded (FIG. 1D), however, the package sleeve 13 (and the package to be manufactured from this) is no longer folded along the apparent folding lines 10. This is why they are called "apparent" folding lines 10.

Figure 1E:
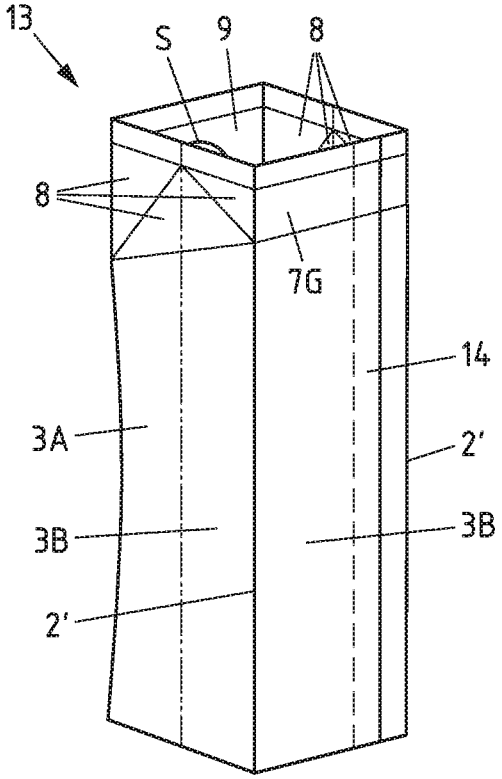

FIG. 1E shows the package sleeve from FIG. 1B to FIG. 1D with the base sealed. The regions of the package sleeves already described in connection with FIG. 1A to FIG. 1D are labelled accordingly in FIG. 1D. The base can for example be sealed while the unfolded package sleeve 13 is pushed onto a mandrel on a mandrel wheel. In order to seal the base, the lower triangular surfaces 8 are for example firstly folded inwards before the lower rectangular surfaces 7B are folded inwards. The folded surfaces are then fused by means of pressure and temperature.

FIG. 1F shows the package sleeve from FIG. 1B to FIG. 1E with pre-folded gable surfaces. The regions of the package sleeve already described in connection with FIG. 1A to FIG. 1E are labelled accordingly in FIG. 1F. "Pre-folded state" means a state in which the two folding lines 2 in the region of the gable surfaces 5 have been pre-folded. The rectangular surfaces 7G and the main gable surface 9 are folded inwards during the pre-folding and later form the gable of the packages. The triangular surfaces 8, however, are folded outwards during the pre-folding and form protruding areas of excess material which are also known as "ears" 15 and are placed on the sleeve surface 3 of the package in a later manufacturing step, for example by means of an adhesive process.

FIG. 1G shows a package 16 manufactured from the package sleeve 13 shown in FIG. 1B to FIG. 1F with an unshaped gable. The regions of the packages already described in connection with FIG. 1A to FIG. 1F are labelled accordingly in FIG. 1G. The package 16 is shown after fusing, in other words once it has been filled and sealed. An enlarged main gable surface 9 is generated as a result the enlarged length $L5_{max}$ of the main gable surface 9 in the region adjacent to the inner partial region 3A of the sleeve surface 3 and the decreased length $L5_{min}$ of the gable surface 5 in the region adjacent to the outer partial areas 3B of the sleeve surface 3. The package 16 can be provided with a pouring element on this main gable surface 9 which stretches until almost the front edge 11 which is arched forwards. A fin seam 17 is generated in the region of the gable surfaces 5 after sealing. In FIG. 1G the ears 15 and the fin seam 17 both protrude. The ears 15 are applied in a subsequent manufacturing step, for example by means of an adhesive process, resulting in the fin seam 17 automatically remaining in a flat position.

FIG. 1H shows the package 16 from FIG. 1G with the shaped gable, in particular with the ears 15 applied. The regions of the packages already described in connection with FIG. 1A to FIG. 2G are labelled accordingly in FIG. 1H. In addition to the ears 15, the fin seam 17 is also applied to the packages 16. The upper ears 15 arranged in the region of the gable surface 5 are folded down and applied flat to the sleeve surface 3. The ears 15 are preferably attached to the sleeve surface 3 by means of adhesion or fusion. The package 16 shown in FIG. 1H does not have any folding edges in the region of the front sleeve surface 3A. The front side of the package which is curved forwards can clearly be recognised in the horizontal section through plane E of the packages shown on the right. The straight folding lines 2' on the rear edges of the packages run from the lower corner points E4 to the upper corner points E5.

Figure 2:
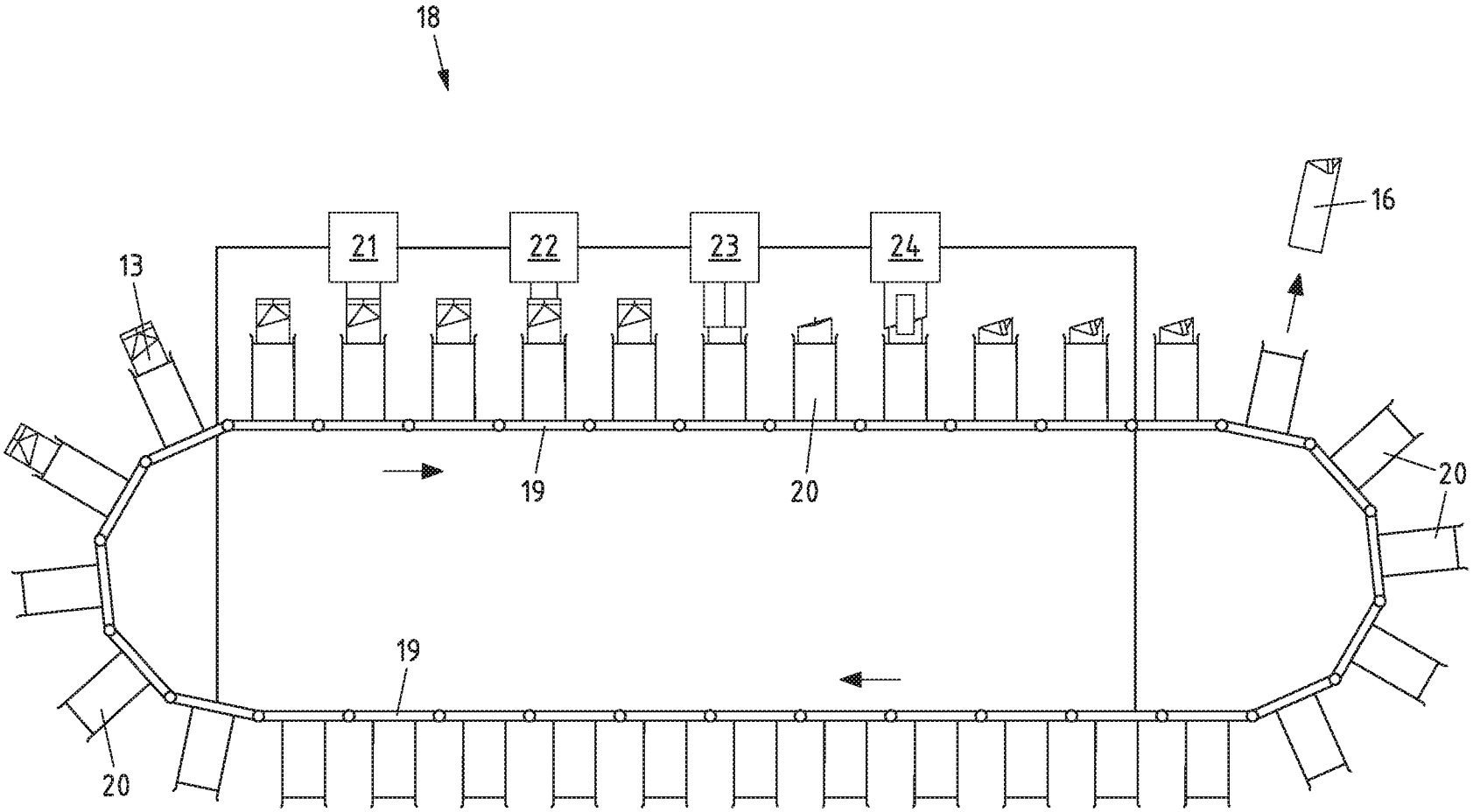
FIG. 2: is a lateral view of a system for the filling and sealing of packages.

FIG. 2 is a lateral view of a system 18 for the filling and sealing of packages. The system 18 comprises a circumferential conveyor system 19 with cells 20 fixed to it to receive package sleeves 13. The package sleeves 13 are inserted into the cells 20 as shown in FIG. 1E, in other words with the base surfaces already sealed. The system 18 comprises a device 21 for the pre-folding of the gable surfaces, a device 22 for the filling of the package sleeves, a device 23 for the sealing of the package sleeves and a device 24 for the shaping of the gables of the packages 16. The gable surfaces are pre-folded in the manner described above in the device 21 for the pre-folding of the gable surfaces with the package sleeves 13 taking the shape shown in FIG. 1F. The package sleeves 13 are filled with the contents in the device 22 for filling the package sleeves. The package sleeves 13 are then sealed in the device 23 for sealing the package sleeves, taking the shape shown in FIG. 1G. After sealing the package sleeves 13 are then called packages 16. The packages 16 are then processed in the device 24 for shaping the gables of the packages such that they take the shape shown in FIG. 1H. The processing comprises the movement of the fin seam 17 and the application of the ears 15. The packages 16 are then removed from the cells 20 of the conveyor system 19.

Figure 3B:
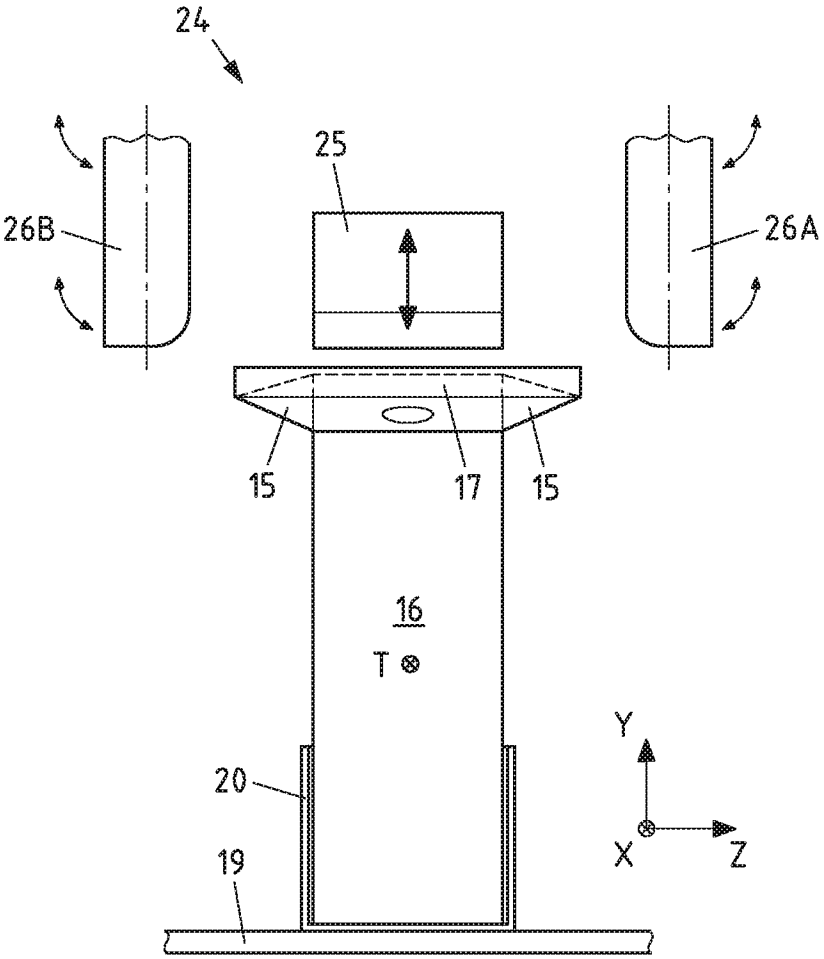
FIG. 3B: is a front view of the device from FIG. 3A, FIG. 3C: is a lateral view of a device 24 for the shaping of gable surfaces of packages with slanted gables in accordance with the invention in a half closed position.
Figure 3A:
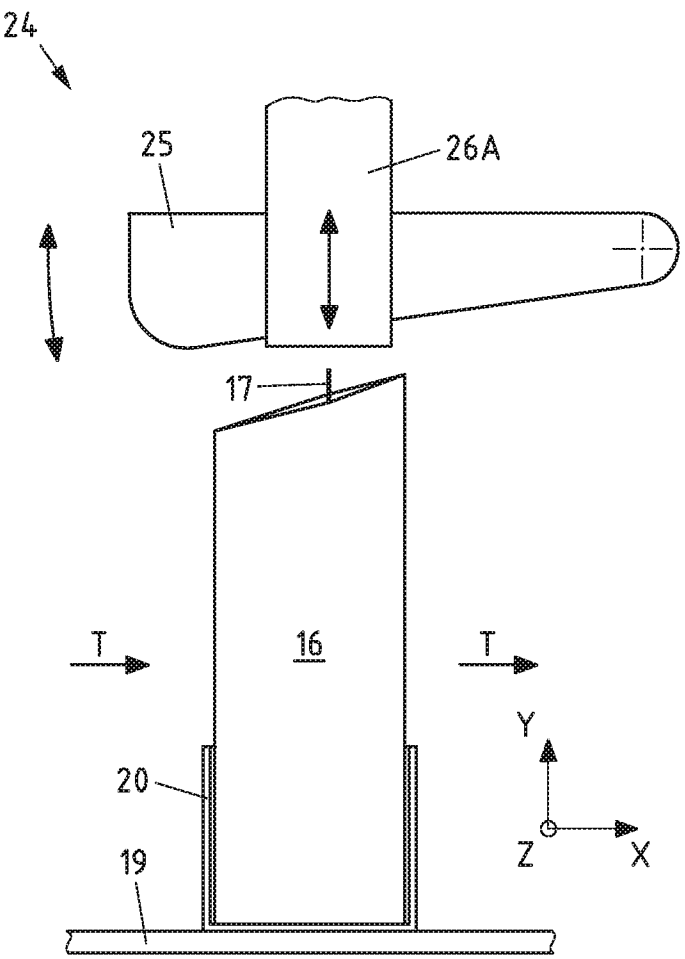
FIG. 3A: is a lateral view of a device 24 for shaping the gable surfaces of packages with a slanted gable in accordance with the invention in an open position.

FIG. 3A is a lateral view of a device 24 in accordance with the invention for shaping the gable surfaces of packages with a slanted gable in an open position. FIG. 3B is a front view of the device 24 from FIG. 3A. The device 24 comprises three folding tools: one gable folder 25 arranged in a central location and two ear folders 26A, 26B arranged adjacent to this. The gable folder 25 is mounted in a mobile manner and is used to move the fin seam 17. The two ear folders 26A, 26B are also mounted in a mobile manner and are used to move the two ears 15. The mobile mounting of the gable folder 25 has the advantage that the fin seam 17 can easily be reached although it can be arranged lower than the highest edge of the package 16. The gable folder 25 is mounted such that it can be moved in a plane which is formed by the longitudinal direction corresponding to the direction of transport of the packages 16 (shown as the X direction in FIG. 3A to FIG. 3F) and the vertical direction (shown as the Y direction in FIG. 3A to FIG. 3F). The two ear folders 26A, 26B, however, are mounted such that they can be moved in a plane formed by the transverse direction (shown as the Z direction in FIG. 3A to FIG. 3F) and the vertical direction (shown as the Y direction in FIG. 3A to FIG. 3F) of the packages 16. The direction of movement of the folding tools 25, 26A, 26B is shown schematically using double arrows. The (open) position of the folding tools shown in FIG. 3A and FIG. 3B is characterised in that none of the folding tools comes into contact with the package 16 and in that the package 16 can be moved between the folding tools in a direction of transport T without any collisions.

Figure 3D:
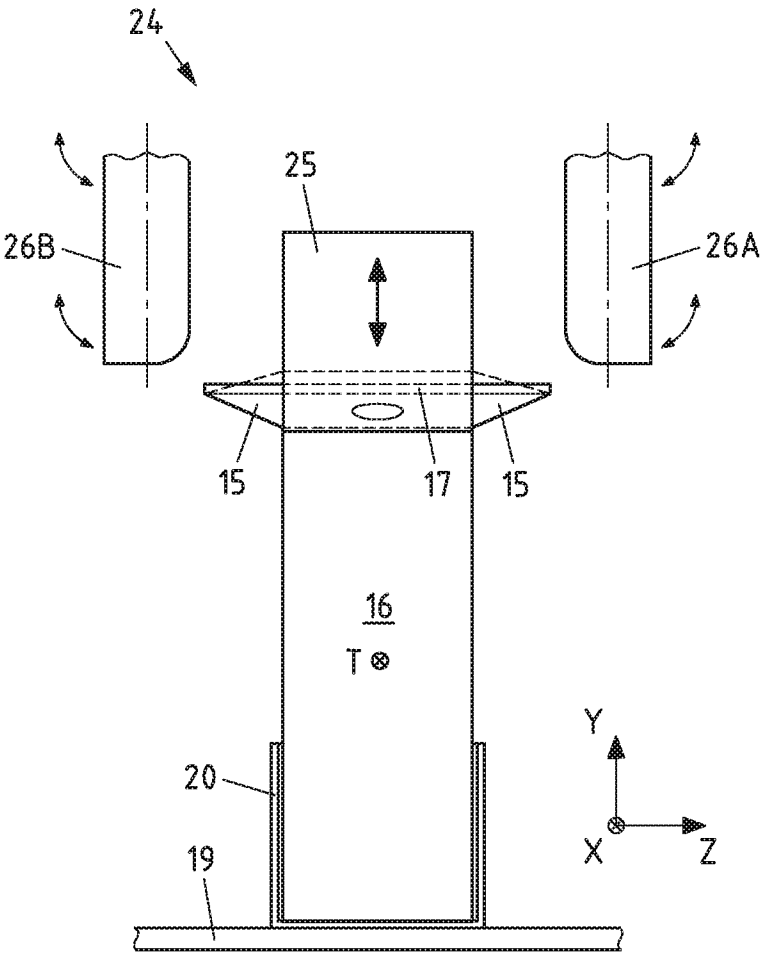
FIG. 3D: is a front view of the device from FIG. 3C, FIG. 3E: is a lateral view of a device 24 for the shaping of gable surfaces of packages with a slanted gable in accordance with the invention in a closed position
Figure 3C:
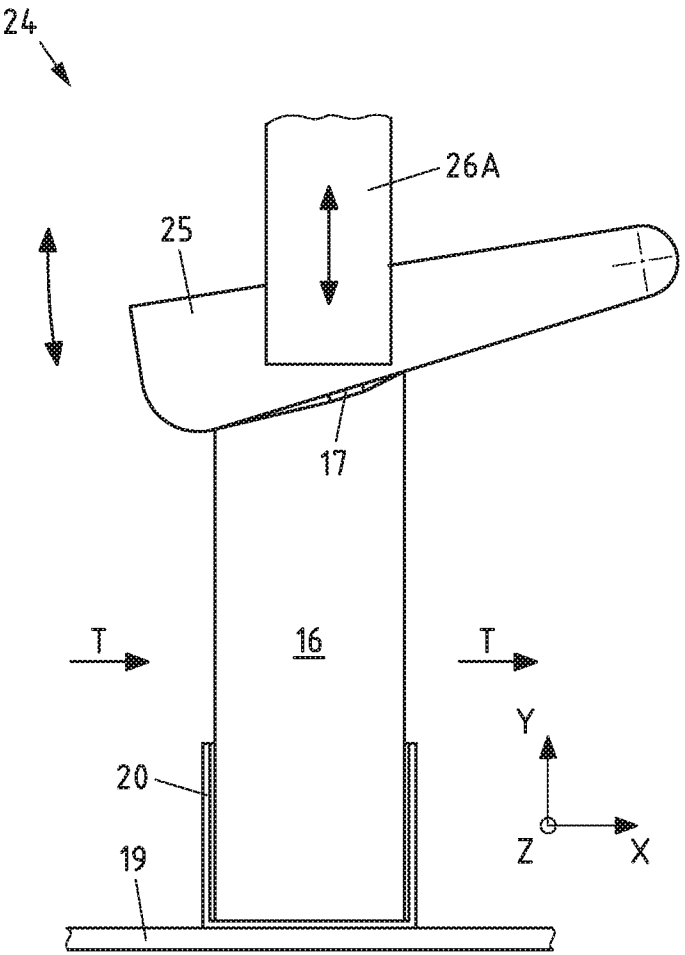
FIG. 3F: is a front view of the device from FIG. 3E.

FIG. 3C is a lateral view of a device 24 in accordance with the invention for shaping the gable surfaces of packages with a slanted gable in a half closed position. FIG. 3D is a front view of the device 24 from FIG. 3C. The regions of the device already described in connection with FIG. 1A to FIG. 3B are labelled accordingly in FIG. 3C and FIG. 3D. The (closed) position of the folding tools shown in FIG. 3C and FIG. 3D is characterised in that the gable folder 25 is pivoted in a downward direction, thereby moving the fin seam 17 in the direction of transport T. The two ear folders 26A, 26B, however, have not yet been moved and take up the same position as in FIG. 3A and FIG. 3B.

Figure 3F:
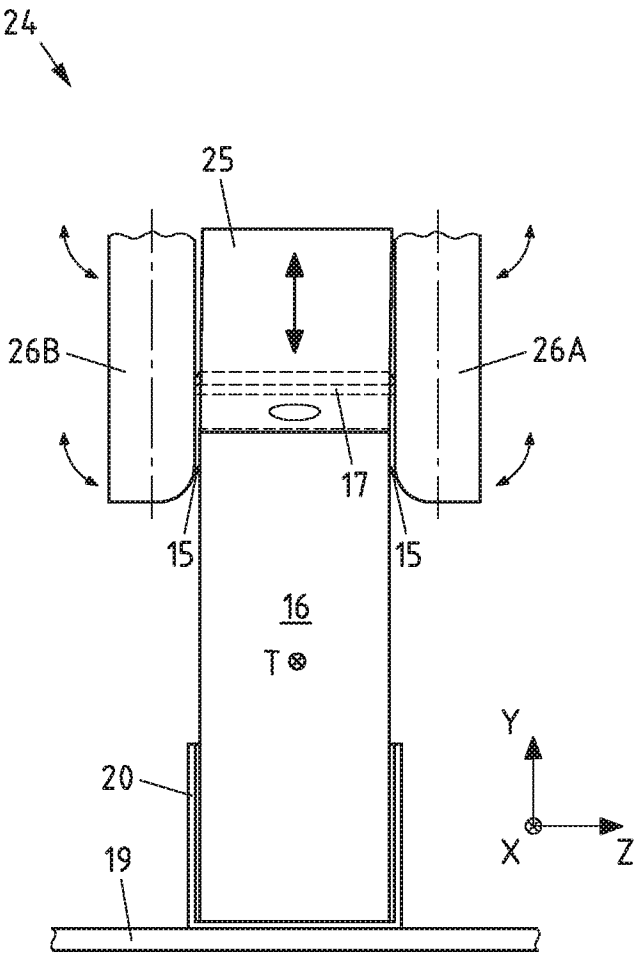
Figure 3E:
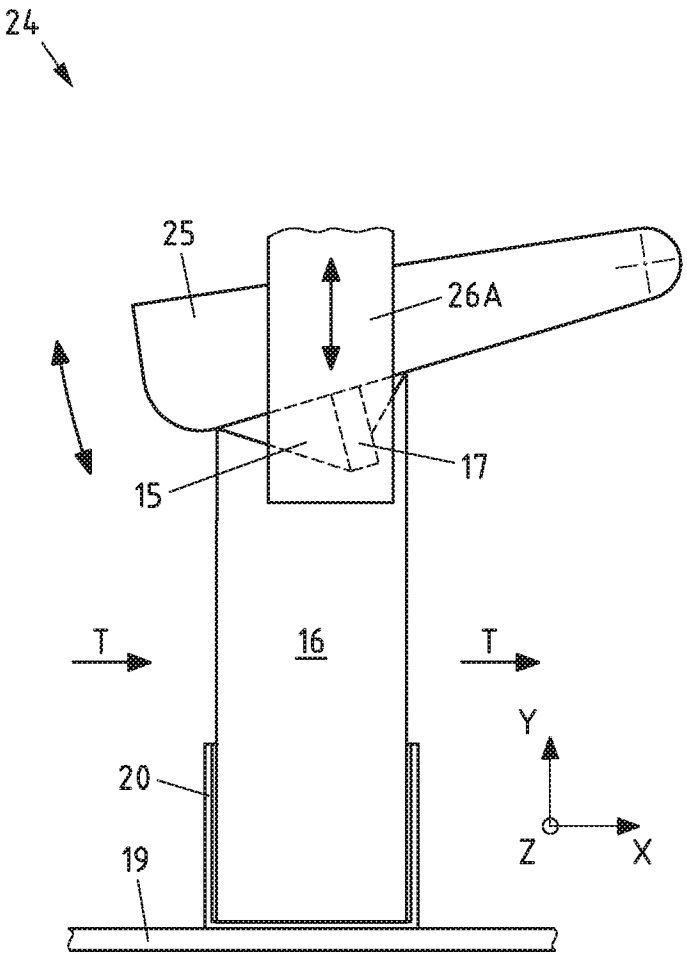

FIG. 3E is a lateral view of a device 24 in accordance with the invention for shaping the gable surfaces of packages with a slanted gable in a closed position. Finally, FIG. 3F is a front view of the device 24 from FIG. 3E. The regions of the device already described in connection with FIG. 1A to FIG. 3D are labelled accordingly in FIG. 3E and FIG. 3F. The (closed) position of the folding tools shown in FIG. 3E and FIG. 3F is characterised in that both the gable folder 25 and the two ear folders 26A, 26B are pivoted in a downwards direction. The gable folder 25 has moved the fin seam 17 in the direction of transport T and the two ear folders 26A, 26B have folded the ears 15 in a downward direction and applied them to the sleeve surface 3 of the package 16.

LIST OF REFERENCE NUMERALS

1: Blank
2, 2': Folding line
3: Sleeve surface
3A, 3B: Partial region (of the sleeve surface 3)
4: Base surface
5: Gable surface
6: Sealing surface
7, 7B, 7G: Rectangular surface
8: Triangular surface
9: Main gable surface
10: Apparent folding line
11: Front edge
12: Stamped line
13: Package sleeve
14: Longitudinal seam
15: Ear
16: Package
17: Fin seam
18: System
19: Conveyor system
20: Cell
21: Device for pre-folding
22: Device for filling
23: Device for sealing
24: Device for gable shaping
25: Gable folder
26A, 26B: Ear folder
E4: Corner point (of base surface 4)
E5: Corner point (of gable surface 5)
L4: Length (of base surface 4)
$L5_{min}$: minimum length (of gable surface 5)
$L5_{max}$: maximum length (of gable surface 5)
S: Tear line
SB: Contact point (of base surface 4)
SG: Contact point (of gable surface 5)
T: Direction of transport
X: Longitudinal direction
Y: Vertical direction
Z: Transverse direction

The invention claimed is:

1. A device for the shaping of gable surfaces of packages with a slanted gable, comprising:

a conveyor system comprising cells for receiving the packages, at least one gable folder for folding a fin seam in a gable region of the packages, at least two ear folders for folding ears in the gable region of the packages, wherein both the gable folder and the ear folders are mounted movably relative to the conveyor system and the packages transported by said conveyor system, and the at least one gable folder is mounted movably in one plane and has at least a two-dimensional mobility, and wherein the at least one gable folder is mounted movably such that it can fold the fin seam in the gable region of the packages forward in the direction of transport of the packages.

2. The device according to claim 1, wherein the at least one gable folder is mounted movably in a plane formed by the direction of transport and the vertical direction of the packages.

3. The device according to claim 1, wherein the at least two ear folders are mounted movably in a plane formed by the vertical direction and the transverse direction of the packages.

4. The device according to claim 1, wherein the at least one gable folder is arranged between the at least two ear folders.

5. The device according to claim 1, comprising at least two gable folders for folding a fin seam in the gable region of the packages, and at least four ear folders for folding ears in the gable region of the packages, wherein one gable folder and two ear folders form a unit for processing a package in each case.

6. The device according to claim 5, wherein all of the gable folders are adjacent to one another and connected to one another, and in that all ear folders are adjacent to one another and connected to one another.

7. A method for the shaping gable surfaces of packages with a slanted gable, comprising:

providing packages comprising gables that can be slanted, folding of a fin seam in a gable region of the packages forward in the direction of transport by means of a gable folder, and folding at least one ear in the gable region of the package by means of two ear folders, wherein both the gable folder and the ear folders are moved relative to a conveyor system and the packages are transported using said conveyor system, and wherein at least one of the following is provided:

the fin seam on the slanted gable is arranged transverse to the direction of transport of the packages, or the slanted gables rise in the direction of transport of the package.

8. The method according to claim 7, wherein the conveyor system comprises fixed cells.

9. The method according to claim 7, wherein the packages are moved intermittently.

10. The method according to claim 7, wherein the packages are still during the folding of the fin seams and the folding of the ears.

11. The method according to claim 7, wherein the folding of the fin seams is carried out before the folding of the ears.

12. The method according to claim 7, wherein there is an overlap in terms of the time at which the folding of the fin seams and the folding of the ears are carried out.

13. The method according to claim 7, wherein the gable folder moves the fin seam in the gable region of the packages in the direction of transport of the packages.

14. The method according to claim 7, wherein the gable surfaces of at least two packages are shaped simultaneously.

* * * * *